US006062181A

United States Patent [19]

von Gaisberg et al.

[11] Patent Number: 6,062,181

[45] Date of Patent: May 16, 2000

[54] ARRANGEMENT FOR AN ELECTROMAGNETIC VALVE TIMING CONTROL

[75] Inventors: Alexander von Gaisberg, Fellbach; Thomas Stolk, Kirchheim, both of Germany

[73] Assignee: DaimlerChrysler AG, Stuttgart, Germany

[21] Appl. No.: 09/031,741

[22] Filed: Feb. 27, 1998

[30] Foreign Application Priority Data

Feb. 27, 1997 [DE] Germany ..... 197 07 810

[51] Int. Cl.[7] ..... F01L 9/04

[52] U.S. Cl. ..... 123/90.11; 123/90.65; 123/90.67; 251/129.01; 251/129.16

[58] Field of Search ..... 123/90.11, 90.65, 123/90.67; 251/129.01, 129.1, 129.15, 129.16

[56] References Cited

FOREIGN PATENT DOCUMENTS 0 245 614 A1 11/1987 European Pat. Off. .

0 722 039 A1 7/1996 European Pat. Off. .

33 07 070 C2 11/1985 Germany .

*Primary Examiner*—Weilun Lo

*Attorney, Agent, or Firm*—Evenson McKeown Edwards & Lenahan P.L.L.C.

[57] ABSTRACT

An arrangement for an electromagnetic valve timing gear has an armature plate which can be adjusted between two end positions and which is held in the end positions by a solenoid system having switching magnets. A spring device with a resilient element is provided on the valve tappet such that, when the solenoid system is not excited, the armature plate takes up an approximate center position between the two switching magnets. The resilient element of the spring device is arranged between two spring plates. The spring plates have an opening, in which case the valve tappet and the spring plate are arranged to be relatively displaceable. On the side of the valve plates facing away from the resilient element, one drive device respectively is provided on the valve tappet, and one path limiting device respectively is provided for the spring plates.

20 Claims, 5 Drawing Sheets

ARRANGEMENT FOR AN ELECTROMAGNETIC VALVE TIMING CONTROL

This application claims the priority of German application 197 07 810.9, the disclosure of which is expressly incorporated by reference herein.

The present invention relates to an arrangement for an electromagnetic valve timing gear, and more particularly to an arrangement with an armature plate which is adjustable between two end position and which is held in the end positions by a solenoid system having a switching magnet, being connected with a valve tappet, and a spring device being provided on the valve tappet which has a resilient element such that, when the solenoid system is not excited, the armature plate takes up an approximate center position between the two switching magnets.

DE 33 07 070 C2 describes an adjusting device for a charge-cycle valve of an internal-combustion engine in which a solenoid system with a switching magnet is arranged. When the solenoid system is de-energized, an armature plate is in a neutral position. In addition, a vibratory spring mass system with two springs are arranged on both sides of the armature plate.

The springs of the known spring mass system are disadvantageously installed under prestress. During switching operation of the adjusting device, potential energy is transmitted from one spring to the other. Furthermore, because of the prestressing force, larger-dimensioned springs are required.

An object of the present invention is therefore to provide an arrangement for an electromagnetic valve timing gear in which, while the solenoid system is de-energized, a neutral position of a switching element exists independently of a spring constant and in which the expenditures for the spring system are low.

According to the present invention, this object has been achieved by providing an arrangement in which the resilient element is arranged between two spring plates which have openings, in that the valve tappet and the spring plates are arranged to be displaceable relative to one another, and in that, on the side of the spring plates facing away from the resilient element, one drive device respectively is provided on the valve tappet and one path limiting device is provided for the spring plates.

The arrangement of a spring device according to the present invention which has two spring plates and a resilient element results, in the de-energized condition of a solenoid system, in the spring plates resting, on path limiting devices, whereby a precisely definable neutral position of a valve tappet is achieved independently of a spring constant.

Furthermore, it is an advantage of the present invention that only a single resilient element is required so that the spring device has smaller dimensions than known arrangements. On one hand, this advantage leads to a cost saving during the manufacturing and, on the other hand, to a weight saving which, in turn, contributes to a fuel consumption reduction.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
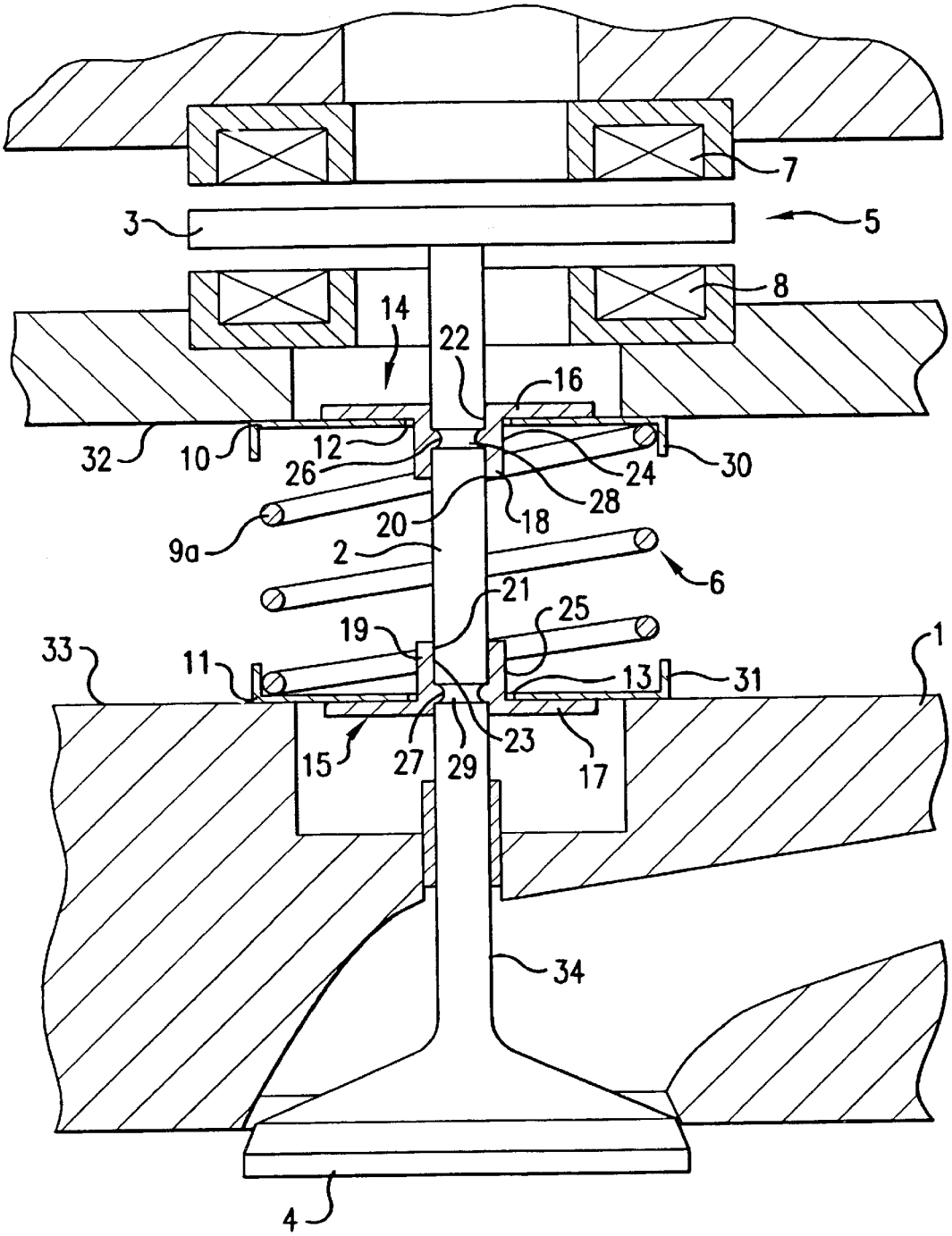
FIG. 1 is a partial cross-sectional view of an arrangement for an electromagnetic valve timing gear arrangement in a cylinder head-having a spring device which has a resilient element which is constructed as a coil spring in which only those parts are discussed in detail which are important for a understanding of the present invention.

FIG. 1 illustrates a valve tappet 2 which is arranged in a cylinder head 1, and has an armature plate 3 and a valve disk 4 which interacts with a valve seat in the cylinder head 1. The armature plate 3 is connected with the valve tappet 2 on its end situated opposite the valve disk 4.

The valve tappet 2 is slidably arranged in the cylinder head 1 such that, as a function of the excitation condition of a solenoid system 5, the armature plate 3 and thus the valve tappet 2 can be held in a valve opening position or a valve closing position.

In the de-energized condition of the solenoid system 5, the valve tappet 2 is held in a neutral position by a spring device 6, wherein the armature plate 3 takes up an approximate center position between two switching magnets 7, 8.

During the valve closing position, the armature plate 3 rests against the switching magnet 7. When the valve tappet 2 is situated in the valve opening position, the armature plate 3 is attracted by the excited switching magnet 8 and is held in this position.

Between the spring plates 10, 11, the spring device 6 has a coil spring 9*a* as the resilient element. The spring plates 10, 11 are arranged in a displaceable manner relative to the valve tappet 2 and coaxially thereon. The valve tappet 2 can be guided through center openings 12, 13 of the spring plates 10, 11.

On the side of the spring plates 10, 11 facing away from the coil spring 9*a*, drive devices 14, 15 for the spring plates 10, 11 are each arranged on the valve tappet 2. The drive devices are constructed as ring elements 14, 15 which each consist of a circular ring 16, 17 and cylindrical bushings 18, 19. The bushings 18, 19 have center openings 20, 21 through which the valve tappet 2 can be guided for the mounting.

The interior shell surfaces 22, 23 of the bushings 18, 19 are constructed as contact surfaces on the valve tappet 2 and the exterior shell surfaces 24, 25 are constructed as guide surfaces for the spring plates 10, 11.

Furthermore, shaped-out areas or projections 26, 27 are provided on the interior shell surfaces 22, 23 and are fitted into grooves 28, 29 of the valve tappet 2, whereby the ring elements 14, 15 can be fixed in a defined position on the valve tappet 2.

In the assembled condition, the spring plates 10, 11 are guided by way of the cylindrical bushes 18, 19 of the ring elements 16, 17 and are slidably arranged there. In order to ensure a guiding of the spring plates 10, 11 on the bushings 18, 19, the height of the bushings 18, 19 is greater than the maximal displacement path of the spring plates 10, 11 or the entire adjusting path of the valve tappet 2 from the closing position to the opening position of the valve disk 4.

A web 30, 31 is constructed on the spring plates 10, 11 on its side which in each case faces the coil spring 9*a*. As illustrated in FIG. 1, the webs 30, 31 may extend along the entire outside diameter of the spring plates 10, 11 or extend in a segment-type manner only along a partial area of the outside diameters of the spring plates 10, 11.

In the de-energized condition of the solenoid system 5, the two spring plates 10, 11 rest flatly against the path limiting devices 32, 33 and against the ring elements 14, 15. Thereby, during the subsequent opening or closing of the valve, the valve tappet 2 can be moved without delay into the position required for this purpose.

When the valve tappet 2 is brought into the closing position of the valve plate 4 by way of the solenoid 7, the ring element 15 together with the valve tappet 2 is displaced such that the ring element 15 lifts the spring plate 11 off the path limiting device 33 and compresses the resilient element 9*a*. The spring plate 10 is pressed by the coil spring 9*a* against the path limiting device 32, and the ring element 14 lifts off the spring plate 10.

When the valve tappet 2 is displaced into an opening position of the valve disk 4, the ring element 14, together with the valve tappet 2, is displaced such that the ring element 14 lifts the spring plate 10 off the path limiting device 32 and compresses the coil spring 9*a*. The spring plate 11 is pressed against the path limiting device 33 by the coil spring 9*a*, and the ring element 15 lifts off the spring plate 11.

Figure 5:
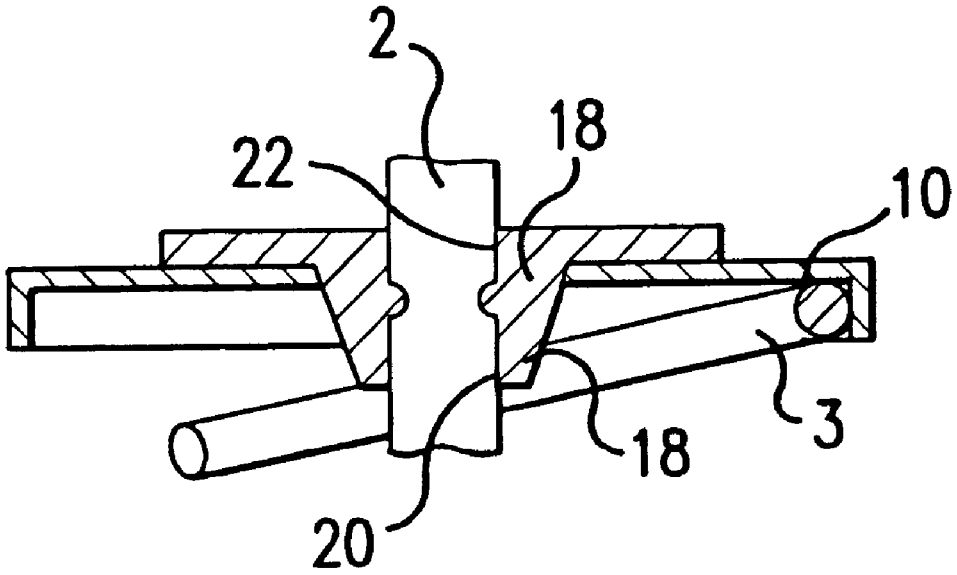
FIG. 5 is a partial cross-sectional view showing the exterior shell surfaces as having a conical configuration.

In the illustrated embodiment, the path limiting devices are steps 32, 33 in the cylinder head 1 and, in a further embodiment not shown in detail, may also be formed by other suitable components, such as stop elements which are fastened on the cylinder head 1. In a further embodiment not shown in detail, the exterior shell surfaces 24, 25 which, in the present embodiment, are situated coaxially to an exterior shell surface 34 of the valve tappet 2, can have a conical construction as seen in FIG. 5. As a result, a self-centering is achieved of the spring plates 10, 11 on the ring elements 14, 15.

The spring ends of the coil spring 9*a* rest on the interior sides of the webs 30, 31 facing the valve tappet 2, whereby a lateral guiding of the coil spring 9*a* is ensured.

Figure 2:
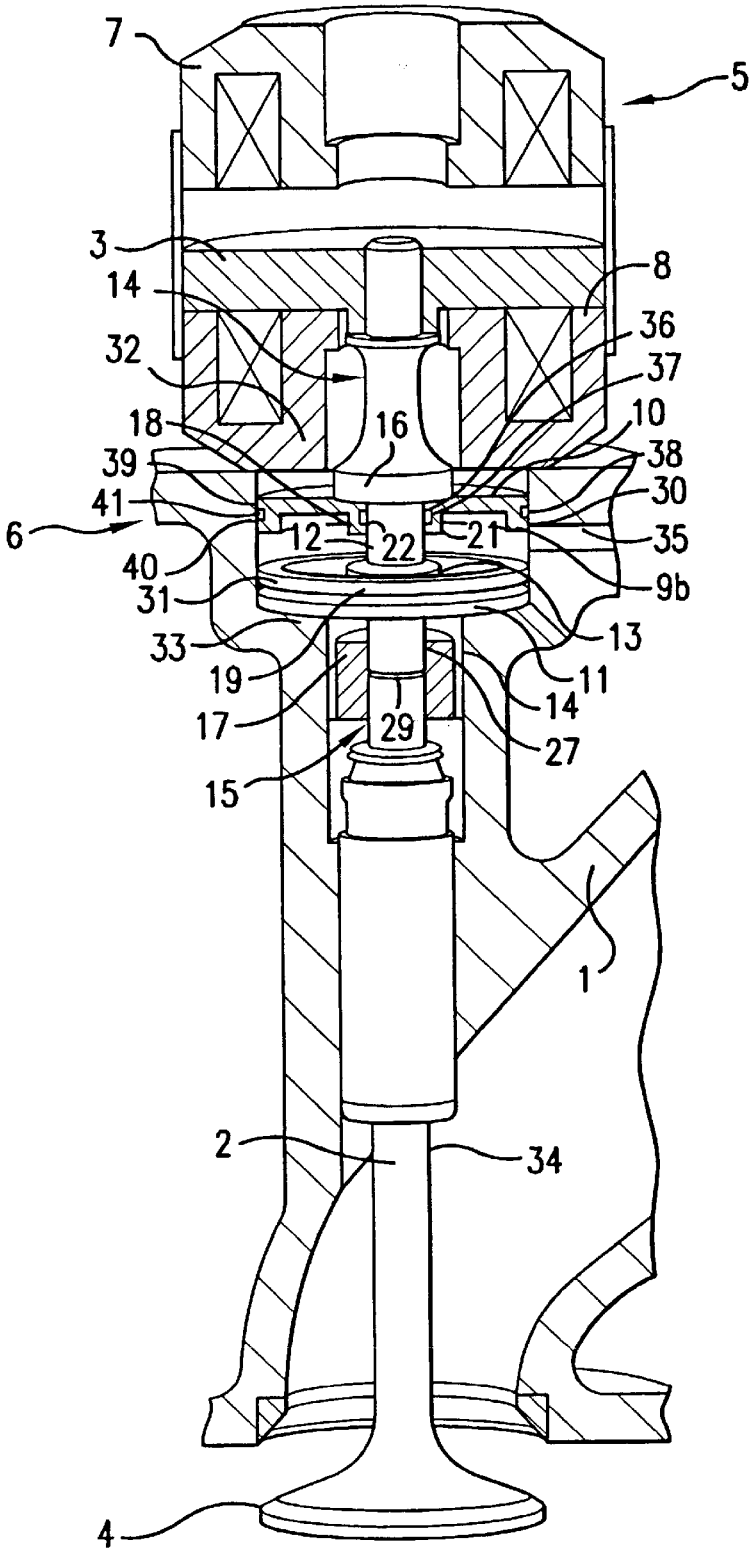
FIG. 2. is a perspective, partial cross-sectional view of another embodiment of the arrangement in the opened position, in which a resilient element is constructed as a pneumatic spring.
Figure 3:
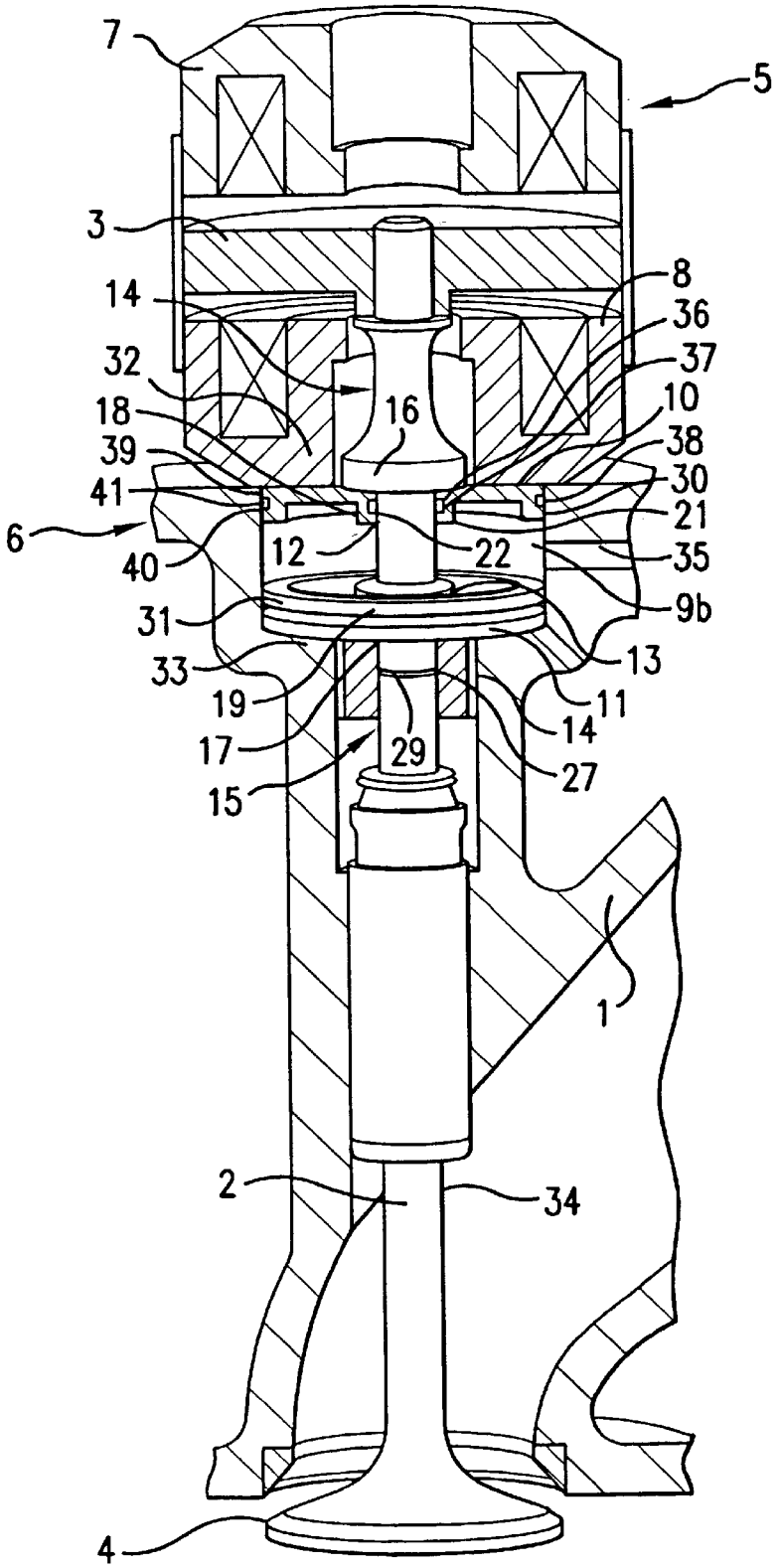
FIG. 3 is a view of the arrangement similar to FIG. 2 but with the arrangement in a neutral position.
Figure 4:
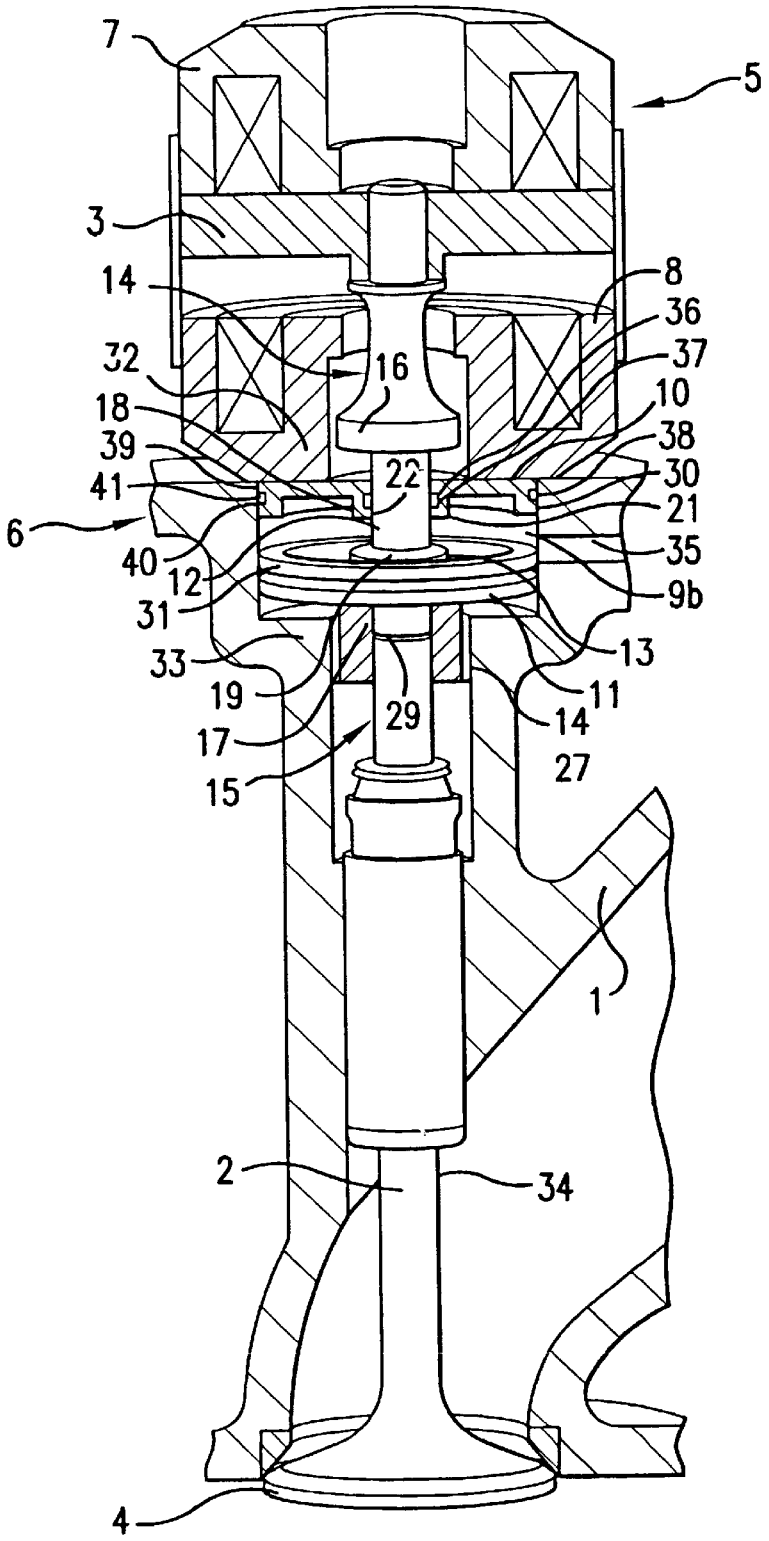
FIG. 4 is a view similar to FIGS. 2 and 3 but with the arrangement in the closed position.

In the embodiment of the arrangement illustrated in FIGS. 2 to 4, the resilient element is constructed as a pneumatic spring 9*b*. Otherwise, the embodiment illustrated in FIGS. 2 to 4 is basically of the same construction as the embodiment shown in FIG. 1, so that the same reference numbers are retained for identical parts.

The pneumatic spring 9*b* is arranged between the spring plates constructed as pistons 10, 11 and the cylinder head 1. A compressed-air feed line 35 is provided in the cylinder head 1 in the area between the pistons 10, 11 to supply the pneumatic spring 9*b* with compressed air.

The cylindrical bushings 18, 19 are constructed in one piece with the pistons 10, 11. One groove 36 respectively is provided on the interior shell surfaces 22, 23 and has an O-ring 37 of a sealing device 38 arranged therein. The ring elements 14, 15 rest against the piston 10, 11 by way of the front side facing in each case the pertaining piston 10, 11. In the assembled condition, the pistons 10, 11 are guided by way of the tappet 2 and are displaceably arranged there.

The webs 30, 31 are constructed on the pistons 10, 11 or the sides thereof which each face the pneumatic spring 9*b*. The webs 30, 31 extend along the entire outside diameter of the pistons 10, 11 and, on their exterior side 39, each have a groove 40 in which, for the purpose of sealing, an O-ring 41 of a sealing device 42 is provided on the cylinder head 1 or a valve housing. The exterior sides 39 of the webs 30, 31 are, on one hand, used as guiding surface of the pistons 10, 11 in the cylinder head 1 and, on the other hand, for receiving the sealing device 42.

In the de-energized condition of the solenoid system 5, the two pistons 10, 11 rest flatly against the path limiting devices 32, 33 and against the ring elements 14, 15. When the valve tappet 2 is brought into the closing position of the valve disk 4 by way of the switching magnet 7, the ring element 15, together with the valve tappet 2, is displaced such that the ring element 15 lifts the piston 11 off the path limiting device 33 and compresses the pneumatic spring 9*b*. The piston 10 is pressed by the pneumatic spring 9*b* against the path limiting device 32, and the ring element 14 lifts off the piston 10.

When the valve tappet 2 is displaced into an opening position of the valve disk 4 as seen in FIG. 2, the ring element 14, together with the valve tappet 2, is moved such that the ring element 14 lifts the piston 10 off the path limiting device 32 and compresses the pneumatic spring 9*b*. The piston 11 is pressed against the path limiting device 33 by the pneumatic spring 9*b*, and the ring element 15 lifts off the piston 11. The path limiting device 33 is constructed as a step which is provided in the cylinder head 1, and the path limiting device 32 is formed by the switching magnet 8.

The sealing devices 38, 42 arranged for the sealing of the pneumatic spring 9*b* between the pistons 10, 11 and the valve tappet 2 as well as the cylinder head 1 have utilized the O-rings 37, 41 as sealing bodies. Of course, a person skilled in the art can also use other suitable sealing possibilities which seal off two relatively slidable components against an air or gas penetration.

In comparison to conventional coil springs, the pneumatic spring 9*b* has advantages as, for example, a negligible spring mass and the possibility of being able to change the characteristic spring curve by the variation of the pressure or of the spring volume. Because pneumatic springs generally have a progressive characteristic spring curve, movement sequences can be damped in a particularly advantageous manner.

Furthermore, the characteristic spring curve car, be adjusted by a known type of control device (not shown) as a function of the rotational engine speed and of the engine load and other operating parameters of the internal combustion engine or by taking into account only one of the operating parameters, whereby the fuel consumption and the starting behavior of the motor vehicle can be improved.

Another advantage of the pneumatic spring 9*b* is a small axial installation space which permits a reduction of weight and therefore also lowers the fuel consumption. Likewise, the valve timing gear has a low static mass, whereby shorter response times of the valve timing gear can be achieved. Still an additional advantage is the reduced friction of the pneumatic spring 9*b* during operation, because lower switching forces are required for actuating the valve tappet 2, and the heat development is advantageously reduced by friction.

When the valve is switched off or is left in the closed or in the open position, the pneumatic spring 9*b* can be de-aerated. That is, the pressure between the pistons 10, 11 is reduced whereby the holding current of the switching magnets 7, 8 or the energy consumption can be lowered.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Arrangement for an electromagnetic valve timing gear comprising an armature plate which is adjustable between end positions and which is held in the end positions by a solenoid system having a switching magnet, the armature plate being operatively connected with a valve tappet, and a spring device on the valve tappet which has a resilient element such that, when the solenoid system is not excited, the armature plate takes up an approximate center position between the switching magnets, wherein the resilient element is arranged between two spring plates having openings, the valve tappet and the spring plates being arranged relatively displaceable, and, on each side of the spring plates facing away from the resilient element, one drive device respectively is provided on the valve tappet and one path limiting device is provided for the spring plates.

2. The arrangement according to claim 1, wherein the valve tappet includes the two drive devices which each form a stop for the associated spring plate on the side of the spring plates which faces away from the resilient element.

3. The arrangement according to claim 1, wherein the drive devices are ring elements having openings through which the valve tappet is guided, one bushing respectively being configured on the openings, interior shell surfaces of the bushing being constructed as a stop surface on the valve tappet and its exterior shell surfaces thereof being configured as a guiding surface for the spring plates.

4. The arrangement according to claim 3, wherein the valve tappet includes the two drive devices which each form a stop for the associated spring plate on the side of the spring plates which faces away from the resilient element.

5. The arrangement according to claim 3, wherein shaped-out areas or projections are provided on the interior shell surfaces of the ring elements, and are configured to be fitted into respective grooves of the valve tappet.

6. The arrangement according to claim 3, wherein the exterior shell surfaces of the bushings have a conical construction.

7. The arrangement according to claim 6, wherein shaped-out areas or projections are provided on the interior shell surfaces of the ring elements, and are configured to be fitted into respective grooves of the valve tappet.

8. The arrangement according to claim 1, wherein the spring plates each have a web extending at least along a partial area of outside diameters thereof.

9. The arrangement according to claim 1, wherein the path limiting devices are steps in a cylinder head.

10. The arrangement according to claim 9, wherein the drive devices are ring elements having openings through which the valve tappet is guided, one bushing respectively being configured on the openings, interior shell surfaces of the bush being constructed as a stop surface on the valve tappet and its exterior shell surfaces thereof being configured as a guiding surface for the spring plates.

11. The arrangement according to claim 1, wherein the resilient element is a coil spring.

12. The arrangement according to claim 11, wherein the coil spring is configured and arranged to rest against a side of the spring plates which faces the coil spring and against interior sides of the webs.

13. The arrangement according to claim 1, wherein the resilient element is a pneumatic spring and the spring plates are pistons.

14. The arrangement according to claim 13, wherein a compressed-air line is provided in an area between the spring plates in a cylinder head.

15. The arrangement according to claim 13, wherein one sealing device respectively is arranged between the spring plates, the valve tappet and a cylinder head.

16. The arrangement according to claim 15, wherein a compressed-air line is provided in an area between she spring plates in the cylinder head.

17. The arrangement according to claim 16, wherein the valve tappet includes the two drive devices which each form a stop for the associated spring plate on the side of the spring plates which faces away from the resilient element.

18. The arrangement according to claim 17, wherein the drive devices are ring elements having openings through which the valve tappet is guided, one bushing respectively being configured on the openings, interior shell surfaces of the bushing being constructed as a stop surface on the valve tappet and its exterior shell surfaces thereof being configured as a guiding surface for the spring plates.

19. The arrangement according to claim 18, wherein shaped-out areas or projections are provided on the interior shell surfaces of the ring elements, and are configured to be fitted into respective grooves of the valve tappet.

20. The arrangement according to claim 19, wherein the spring plates each have a web extending at least along a partial area of outside diameters thereof.

* * * * *